US007328554B1

(12) United States Patent
Cerf

(10) Patent No.: US 7,328,554 B1
(45) Date of Patent: Feb. 12, 2008

(54) ADJUSTABLE HEIGHT FILM WRAPPING MACHINE

(76) Inventor: Alain Cerf, 3301 Gateway Center Blvd, Pinellas Park, FL (US) 33782

( * ) Notice: Subject to any disclaimer, the term of this patent is extended or adjusted under 35 U.S.C. 154(b) by 0 days.

(21) Appl. No.: 11/582,408

(22) Filed: Oct. 18, 2006

(51) Int. Cl.
*B65B 11/00* (2006.01)

(52) U.S. Cl. ..... 53/465; 53/48.4; 53/209; 53/588; 100/27; 100/28

(58) Field of Classification Search ..... 53/588, 53/465
See application file for complete search history.

(56) References Cited

U.S. PATENT DOCUMENTS 4,178,739 A * 12/1979 Du Broff ..... 53/588
5,203,146 A * 4/1993 Gambetti ..... 53/557
5,463,846 A * 11/1995 Gambetti ..... 53/465
6,128,888 A * 10/2000 Gambetti ..... 53/465
6,739,115 B1 * 5/2004 Malini ..... 53/588
7,117,658 B2 * 10/2006 Malini ..... 53/588
2004/0083689 A1 * 5/2004 Floding et al. ..... 53/465

* cited by examiner

*Primary Examiner*—John Sipos
(74) *Attorney, Agent, or Firm*—Sam Silverberg

(57) ABSTRACT

The invention is directed to changing the height of the wrapping bar on a lap seal machine so that articles of different heights can be accommodated by making the height of the wrapping bar adjustable to accommodate taller or shorter articles on a conveyor.

16 Claims, 5 Drawing Sheets

ADJUSTABLE HEIGHT FILM WRAPPING MACHINE

This application incorporates by reference US application number not yet assigned by the same inventor filed on the same date. The title of the application is Perforated Film Wrapping Machine.

FIELD OF THE INVENTION

This invention relates to a film wrapping an article on a conveyer using a flying rod. The height of the flying rod is adjustable to accommodate articles of different heights.

BACKGROUND OF THE INVENTION

The prior art teaches wrapping an article with a film on a conveyor using a rod or a bar or roller. Usually a flying rod is used to wrap the film over the article. The flying rod revolves around the conveyor. This requires the rod to pass through the space between the adjacent conveyors. The height of the rod is fixed. Therefore, there are limits on the height of articles that can be wrapped with the conventional film-wrapping machine. These film-wrapping devices are usually found on a lap seal machine.

SUMMARY OF THE INVENTION

The objective of this invention is to be able to change the height of the wrapping bar so that articles of different heights can be accommodated. This is accomplished by making the height of the wrapping bar adjustable to accommodate taller or shorter articles. This requires changing the revolution of the flying rods to accommodate the height of the article while allowing the rods to pass between adjacent conveyors.

THE DRAWINGS

DETAILED DESCRIPTION OF THE INVENTION

Figure 1:
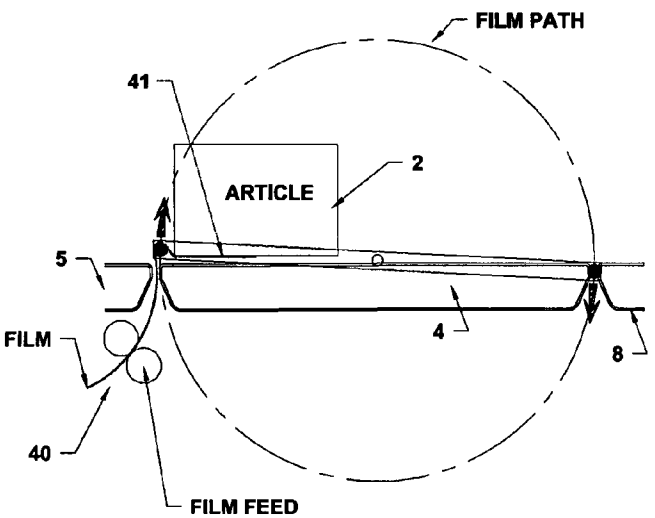
FIGS. 1-3 show the conventional movement of a flying rod moving film over an article on a conveyor between two adjacent conveyors.
Figure 2:
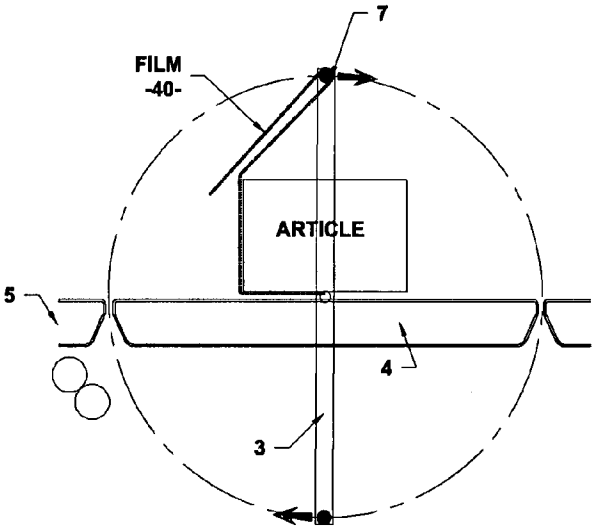
Figure 3:
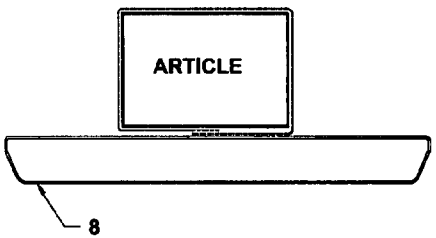
Figure 6:
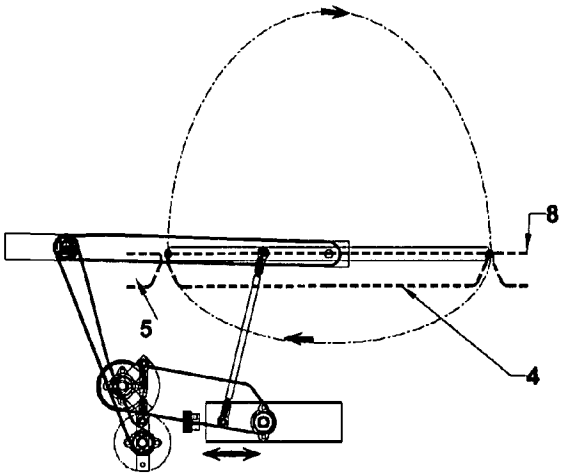
FIGS. 4-6 show the movement of the flying rod with an adjustable height structure to wrap an article and moving between the adjacent conveyors.
Figure 5:
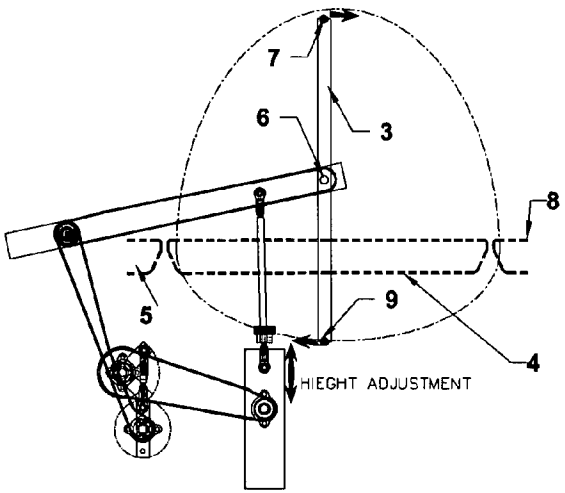

FIGS. 1-3 show a conventional lap seal conveyor system. The article 2 is transferred from conveyor 5 to conveyor 4. Prior to moving article from conveyor 5 to conveyor 4 a film is fed onto the transfer belt of conveyor 4. The length of the film fed on to conveyor 4 is about half the length of the article. This portion of the film is commonly referred to as a flap. The total length of the film is pre cut to a length that allows wrapping of the article and overlapping the flap.

The article is moved onto conveyor 4 so that the article rests on the top of the flap 41 lying on the transfer belt of conveyor 4. While the article is resting on the flap 41, the rod 7 attached to arm 3 picks up the pre cut film 40 from underneath the conveyor 4 by passing through the opening between conveyor 4 and 5. Then the rod passes through the opening between conveyors 4 and 8. The article pushes the remainder of the film under the article so that the flap is overlapped. From there the article is transported to a heat shrink machine that seals the overlap and shrinks the film over the article.

The rods 7 and 9 are attached perpendicular to arm 3. The rotation of arm 3 about axis 6 causes the rods 7 and 9 to rotate around the conveyor. The position of the rods is equidistant to axis of rotation 6. The rotation of the rods is synchronized with the movement of the article on the conveyor. Because the rods are fixed in height, wrapping articles of different heights is a problem in the art.

Figure 4:
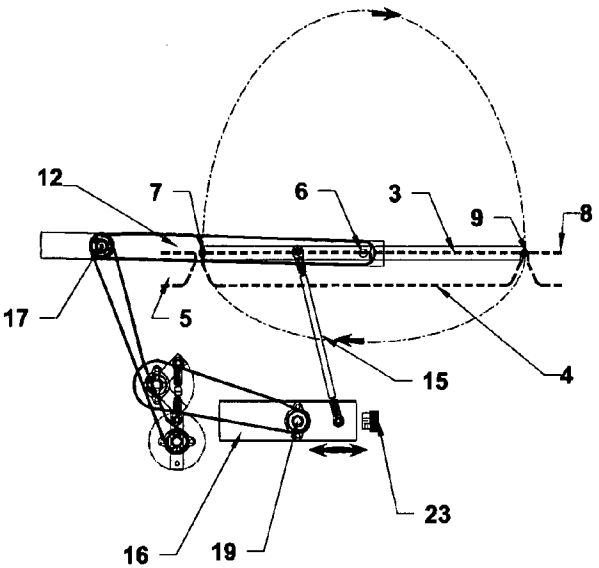
Figure 7:
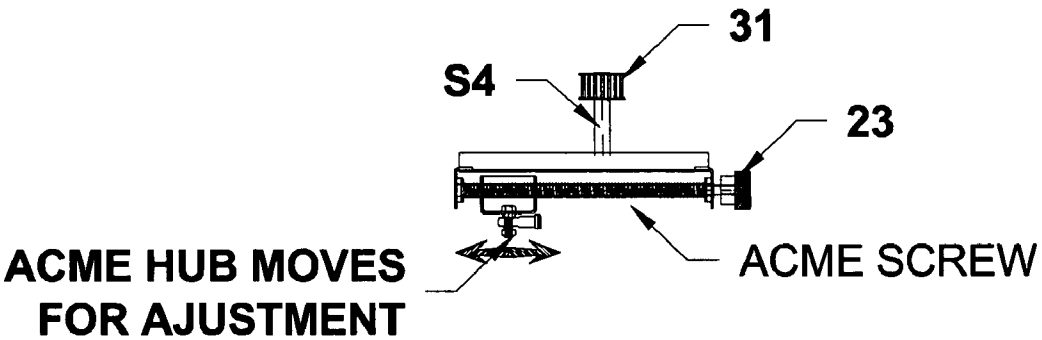
FIG. 7 shows an acme screw with an adjustment knob that can be rotated.
Figure 8:
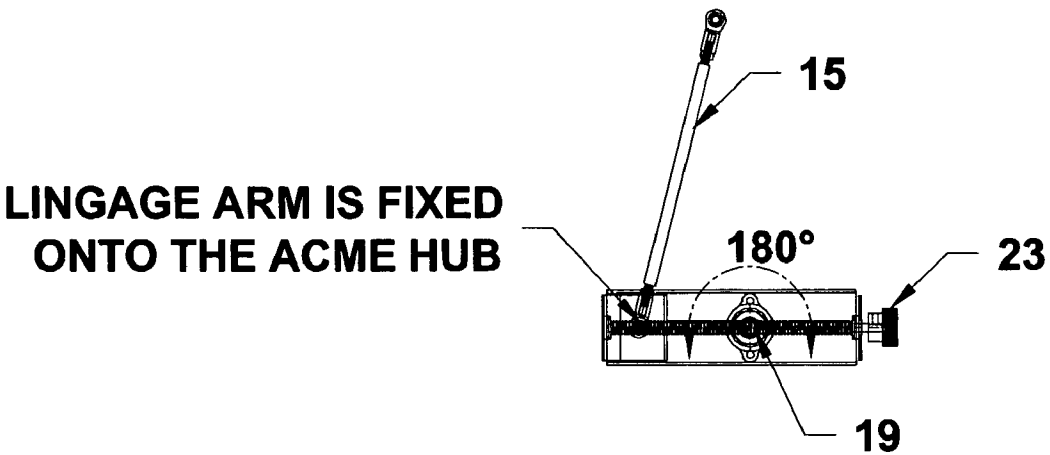
FIG. 8 shows a shaft attached to the acme screw that can be moved along the acme screw by an adjustment screw.
Figure 9:
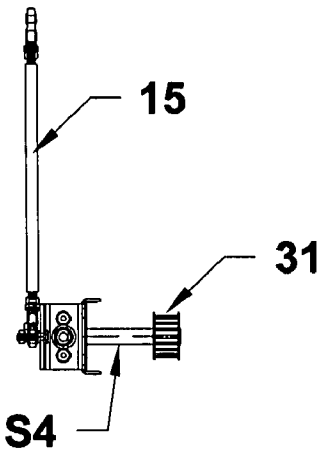
FIG. 9 shows a shaft rotating the acme screw by a pulley.
Figure 10:
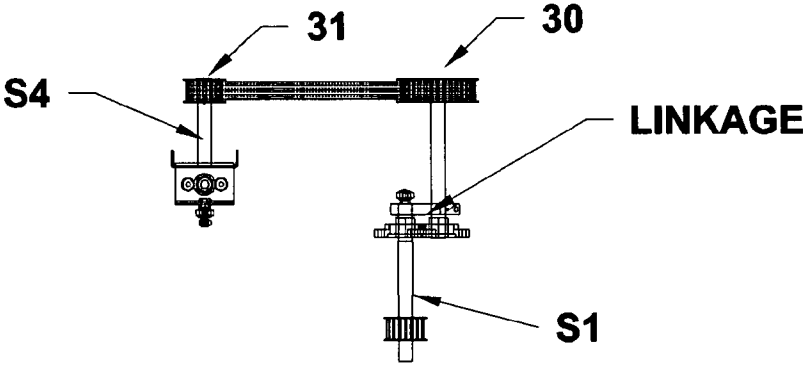
FIGS. 10-13 show the linkage between the moving parts of the film wrapping machine.
Figure 11:
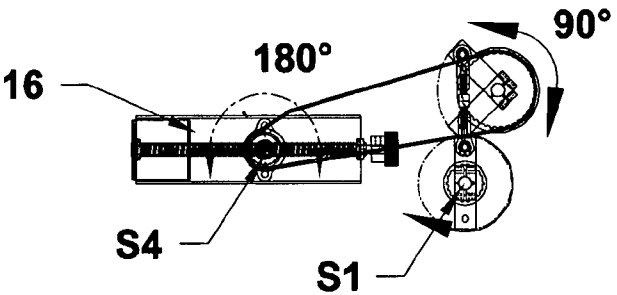
Figure 12:
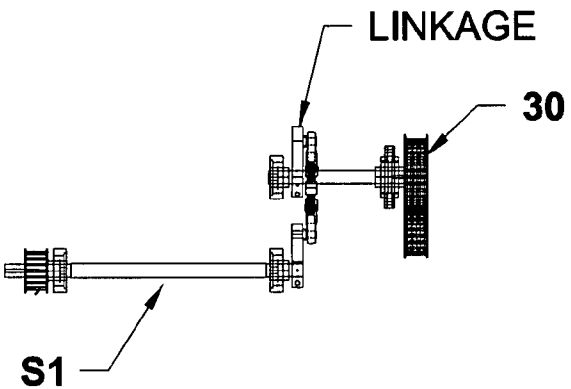
Figure 13:
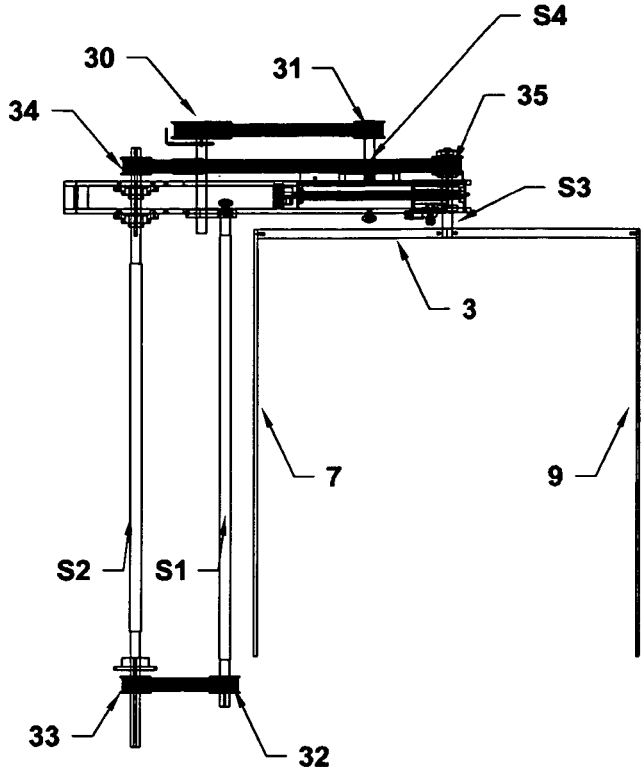
Figure 14:
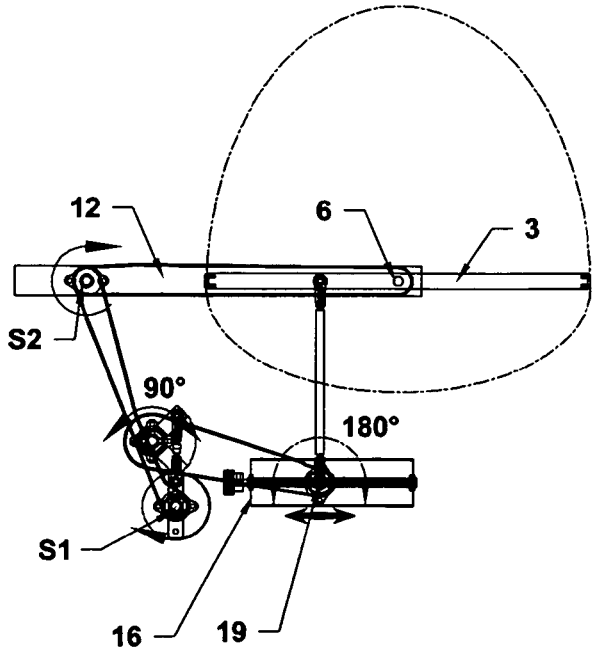
FIG. 14 shows the position of the acme screw when the flying rod is going between the conveyors.

FIGS. 4-7 shows means to change the height of the rod with respect to the article while maintaining a geometry that allows the rods to go between the spaces of the adjacent conveyers 5 and 8. FIG. 4 shows rods 7 and 9 attached to arm 3 and rotating about axis 6 as in FIGS. 1-3. Arm 3 is attached to arm 12. Arm 12 is able to pivot at point 17. One end of shaft 15 is attached to arm 12. The other end is attached to the actuator 16. FIGS. 7, 8 and 9 shows the shaft 15 attached to a screw in the actuator (Acme screw) 16. By turning the adjustment knob the screw moves the position of shaft 15 with respect to the actuator 16. Actuator 16 is mounted to rotate 180 degrees about axis 19. The rotation of the actuator about axis 19 is by a drive pulley 31 mounted on shaft S4 which is attached to the actuator at point 19.

The rotation of the actuator places the rods 7 and 9 in a position where the rods can go between the adjacent conveyors while allowing the height of the rod over the article to be changed. The distance between the adjacent conveyors is usually about 0.5 inches.

Moving the adjustment knob 23 so that the shaft 15 is further away from the axis of rotation of the actuator causes the main arm 12 to be raised. Raising the main arm 12 causes fixed point 6 to raise, thereby causing rod 7 and 9 to be raised. Likewise, moving the adjustment knob 23 so that shaft 15 is closer to the axis of rotation of the actuator causes the main arm 12 to be lowered. Lowering the main arm 12 causes point 6 to be lowered, thereby causing rod 7 and 9 to be lowered. The position of the actuator shown in FIGS. 4 and 5 places the fixed point 6 of arm 3 in the proper position to allow the rods 7 and 9 to go between the adjacent conveyors.

The use of an actuator is a preferred embodiment. Actuator 16 can be replace by any rotating member that would be allow rod 15 to be moved closer or further from the axis of rotation. For example the member might be slotted that would allow rod 15 to be moved to desired position. FIG. 9-14 show the linkage between the movement of the article 2 on the conveyor 4 and the rotation of the flying rods 7 and 9 and the rotation of the actuator 16. Shaft 1 which rotates proportionally to the position of the article on the conveyor. Actuator 19 is rotated by a pulley 31 on shaft S4 which connected by a belt to drive shaft S1 via pulley 30. This pulley 31 is connected to the pulley 30. Arm 3 attached to shaft S3 is connected to shaft S2 by pulley 34 and pulley 35 on shaft S3. Shaft 2 is connected to shaft 1 by pulley 33 and pulley 32 on shaft 1. The pulleys are connected by drive belts. In a preferred embodiment, shafts S1 and S2 and S3 are rotating at the same speed. Shaft S4 is oscillating so that in one revolution of shaft S1 the rotating member is rotated 180 and rotated back 180 to its original position. This accomplished by pulley 30 having a diameter 2 times larger than pulley 31 and having the proper linkage to achieve the oscillation. By selecting the proper pulley ratios the synchronization of the rotation of the flying rods and the actuator with the movement of the article on the conveyor can be achieved to wrap articles of different heights.

The invention claimed is:

1. A film wrapping apparatus comprising means to transport an article from a first conveyor to an adjacent second conveyor where the article is wrapped, means for transporting the article from the second conveyor to an adjacent third conveyor, and means for wrapping the article on the second conveyor with a film including a rotating first arm having a revolving rod attached at each end of the first arm wherein the rods are substantially equally spaced from the axis of rotation of the rotating first arm so that the revolving rods pass between said first and second conveyors and between said second and third conveyors and wherein the rotating first arm is attached at its axis of rotation to a second arm, wherein said wrapping means includes means to adjust the height of said rods carrying the film over the article while maintaining a geometric relationship so that the rods are able to go between the spaces of the adjacent conveyors and wherein said means to adjust includes means for attaching to said second arm to lower and raise said second arm and said rotating first arm.

2. A film wrapping apparatus according to claim 1 having means to feed a length of film on the second conveyor capable of acting as a flap prior to the article being transported on the second conveyor.

3. A film wrapping apparatus according to claim 2 where in the means to transport the article to the second conveyor includes means to position the article so that the article rests on the flap.

4. A film wrapping apparatus according to claim 1 wherein the means to adjust the height of a rod includes a shaft connecting the second arm to a rotating member that allows the shaft to be moved with respect to the axis of rotation of the rotating member.

5. A film wrapping apparatus according to claim 4 wherein the rotating member is an actuator having a screw that can move the shaft closer or further away from the axis of rotation.

6. A film wrapping apparatus according to claim 4 wherein the rotating member rotates 180 degrees in one direction and 180 degrees back to its original position.

7. A film wrapping apparatus according to claim 1 wherein said means for transporting the article form the second conveyor to the third conveyor includes means to overlap the flap with the film on the third conveyor.

8. A film wrapping apparatus according to claim 7 having means to heat shrink the film and seal the overlap.

9. A process for film wrapping an article comprising transporting an article from a first conveyor to an adjacent second conveyor where the article is wrapped, transporting the article from the second conveyor to an adjacent third conveyor, wrapping the article on the second conveyor with a film by rotating a first arm having a revolving rod attached at each end of the first arm which carries the film over the article and passes between said first and second conveyors and between said second and third conveyors, wherein the rods are substantially equally spaced from the axis of rotation of the rotating first arm, wherein the rotating first arm is attached at its axis of rotation to a second arm and adjusting the height of said rods carrying the film over the article, while maintaining a geometric relationship so that the rods are able to go between the spaces of the adjacent conveyers by raising or lowering the second arm to raise or lower the first arm.

10. A process for film wrapping according to claim 9 including feeding a length of film on the second conveyor capable of acting as a flap prior to the article being transported on the second conveyor.

11. A process for film wrapping according to claim 10 including positioning the article on the second conveyor so that the article rests on the flap.

12. A process for film wrapping according to claim 9 including the step of adjusting the height of the rod by connecting a shaft from the second arm to a rotating member by moving the shaft with respect to the axis of rotation of the rotating member.

13. A process for film wrapping according to claim 12 including the step of adjusting the position of the shaft by turning a screw within the rotating member that has the moves the shaft closer or further away from the axis of rotation of the rotating member.

14. A process for film wrapping according to claim 13 including the step of rotating the rotating member 180 degrees in one direction and 180 degrees back to its original position.

15. A process for film wrapping according to claim 11 including transporting the article form the second conveyor to the third conveyor so that the film overlaps the flap on the third conveyor.

16. A process for film wrapping according to claim 15 including heat shrinking the film and sealing the overlap.

* * * * *